US010191455B2

(12) United States Patent
Shim et al.

(10) Patent No.: US 10,191,455 B2
(45) Date of Patent: Jan. 29, 2019

(54) WATCH TYPE TERMINAL

(71) Applicant: LG ELECTRONICS INC., Seoul (KR)

(72) Inventors: Hongjo Shim, Seoul (KR); Mihyun Park, Seoul (KR); Hyunwoo Kim, Seoul (KR); Sungho Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/466,794

(22) Filed: Mar. 22, 2017

(65) Prior Publication Data

US 2018/0039233 A1 Feb. 8, 2018

(30) Foreign Application Priority Data

Aug. 8, 2016 (KR) ..... 10-2016-0100812

(51) Int. Cl.
*G04G 21/08* (2010.01)
*G04G 21/02* (2010.01)

(52) U.S. Cl.
CPC ..... *G04G 21/08* (2013.01); *G04G 21/02* (2013.01); *G04G 21/025* (2013.01)

(58) Field of Classification Search
CPC ..... G04G 21/08; G04G 21/02; G04G 21/025
See application file for complete search history.

(56) References Cited

U.S. PATENT DOCUMENTS 4,224,948 A * 9/1980 Cramer ..... A61B 5/02438 600/503
2010/0076331 A1 3/2010 Chan et al.
2011/0012796 A1* 1/2011 Kim ..... H01Q 1/273 343/702
2015/0105671 A1* 4/2015 Shibuya ..... A61B 5/02427 600/479
2015/0358438 A1 12/2015 Kim et al.
2016/0187857 A1 6/2016 Cho et al.
2017/0042485 A1* 2/2017 Chung ..... G06F 1/163
2017/0134022 A1* 5/2017 Kim ..... H03K 17/955

FOREIGN PATENT DOCUMENTS

KR 1020150099430 8/2015

OTHER PUBLICATIONS

PCT International Application No. PCT/KR2017/000729, Notification of Transmittal of the International Search Report and the Written Opinion of the International Searching Uthority, or Declaration dated May 19, 2017, 12 pages.

* cited by examiner

*Primary Examiner* — Sahlu Okebato
(74) *Attorney, Agent, or Firm* — Lee, Hong, Degerman, Kang & Waimey

(57) ABSTRACT

A watch type terminal is presented, which includes a main body; a band connected to the main body and formed to be worn on a user's wrist; an electrode unit formed in one area of the main body or the band and performing a predetermined function; an electromagnetic wave sensor module connected with the electrode unit and sensing a capacitance change; and a controller sensing whether the user wears the watch type terminal based on the capacitance change and generating a control command based on whether the user wears the watch type terminal.

16 Claims, 13 Drawing Sheets

WATCH TYPE TERMINAL

CROSS-REFERENCE TO RELATED APPLICATION

Pursuant to 35 U.S.C. § 119(a), this application claims the benefit of an earlier filing date of and the right of priority to Korean Application No. 10-2016-0100812, filed on Aug. 8, 2016, the contents of which are incorporated by reference herein in its entirety.

TECHNICAL FIELD

The present invention relates to a watch type terminal of which specific function is controlled through wearing sensing.

RELATED ART

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions may include data and voice communications, capturing images and video through a camera, recording audio, playing music files through a speaker system, and displaying images and video on a display unit. Some mobile terminals additionally provide functions such as playing an electronic game, or executing a function of multimedia players. Especially, recent mobile terminals may receive multicast signal for providing visual content such as broadcasts, videos, or television programs.

As it becomes multifunctional, a mobile terminal can be allowed to capture still images or moving images, play music or video files, play games, receive broadcast and the like, so as to be implemented as an integrated multimedia player.

Efforts are ongoing to support and increase the functionality of mobile terminals. Such efforts include software and hardware improvements, as well as changes and improvements in the structural components.

With the development of a wearable terminal worn on a part of a body of a user, various functions have been implemented, and a security function has been improved by sensing whether a user has worn the wearable terminal and activating or restricting a specific function.

However, a complaint of consumers has been increased, who feel that wearing sensing and heartbeat measurement are inexact as a reflection level of light is varied in accordance with a skin color of a user and a tattoo of a user if any. Particularly, in case of a skin with a tattoo, since it is difficult to sense whether a user has worn the wearable terminal, through an existing IR LED, a problem occurs in that a related function is not executed normally.

SUMMARY OF THE INVENTION

An object of the present invention is to provide a watch type terminal of which wearing on a user is sensed regardless of a state of a skin of the user.

To achieve these and other objects and in accordance with the purpose of the present invention, as embodied and broadly described herein, a watch type terminal according to one embodiment of the present invention comprises a main body; a band connected to the main body and formed to be worn on a wrist of a user; an electrode unit formed in one area of the main body or the band, performing a predetermined function; an electromagnetic wave sensor module connected with the electrode unit, sensing a change of capacitance; and a controller sensing whether the user wears the watch type terminal, based on the change of capacitance and forming a control command based on whether the user wears the watch type terminal.

As an example related to the present invention, the predetermined function corresponds to a wireless communication function, a wireless charging function, an electric connection function of a Usim chip, and a measurement function of a body signal, and the electromagnetic wave sensing function is restricted while the specific function is being performed. Therefore, additional element for sensing electromagnetic waves is not required, and quality deterioration of each function can be prevented from occurring.

As an example related to the present invention, a wearing sensing function may be performed based on a change of a temperature which is sensed. Since a sensing time may be set differently in accordance with an external temperature, exactness of wearing sensing can be improved.

According to the present invention, whether the user wears the watch type terminal can be sensed without using reflected information of light, whereby measurement can be performed and an error can be reduced even though the user has a tattoo on a wrist.

Also, since the electrode unit can perform an antenna function, measure a body signal, or use an electrode structure for wireless charging, additional element is not required, whereby esthetic external appearance can be obtained and efficiency of an inner space can be improved.

Since the electromagnetic wave sensing function can be restricted while the specific function is being performed, function deterioration can be prevented from occurring.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

DETAILED DISCLOSURE OF THE PRESENT INVENTION

Figure 1A:
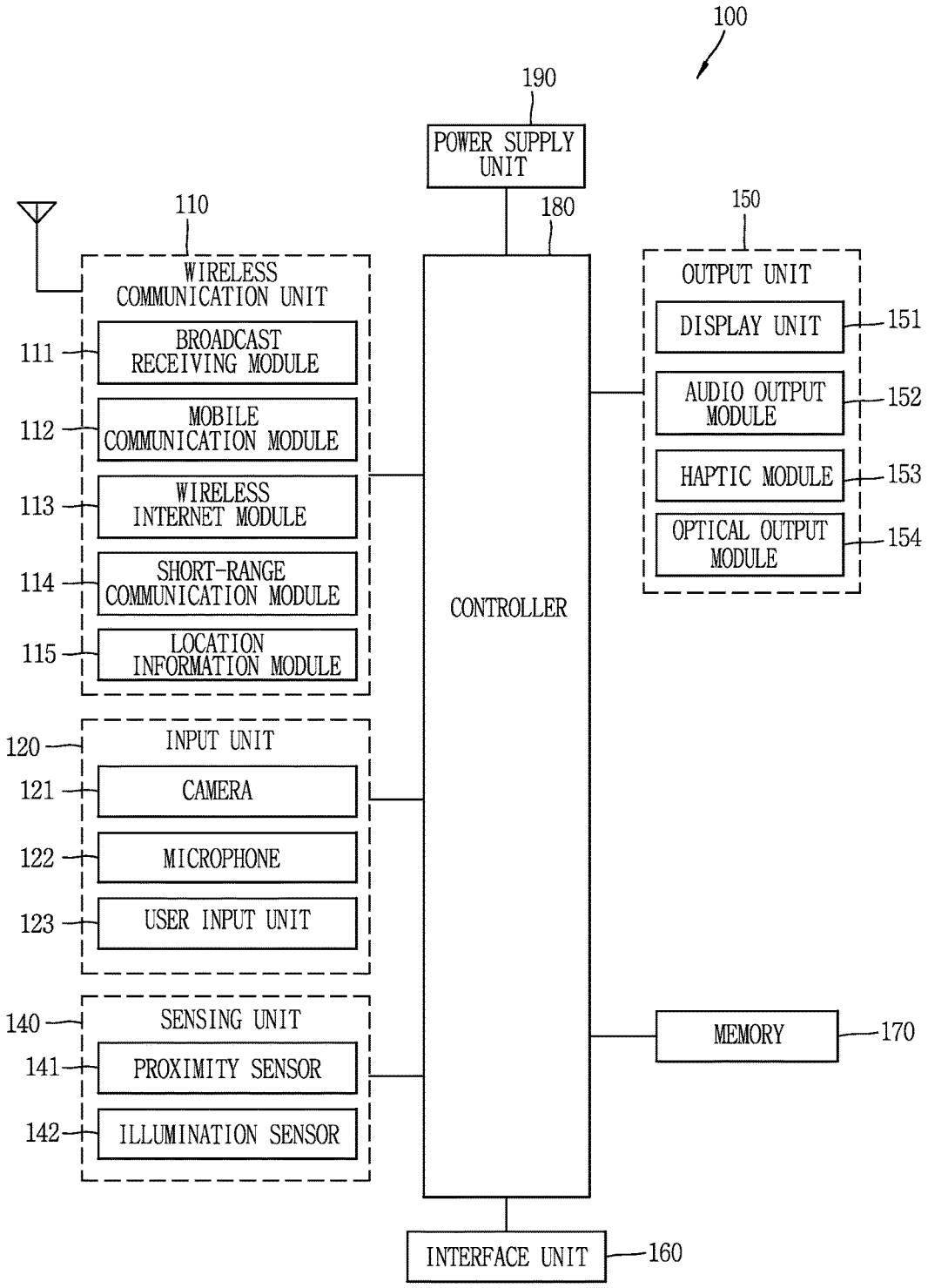
FIG. 1A is a block diagram illustrating a watch type terminal according to the present invention.

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart glasses), head mounted displays (HMDs), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and a digital signage.

FIG. 1A is a block diagram of a mobile terminal in accordance with the present disclosure.

The mobile terminal 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components of FIG. 1A is not a requirement, and that greater or fewer components may alternatively be implemented.

Referring now to FIG. 1A, the wireless communication unit 110 typically includes one or more modules which permit communications such as wireless communications between the mobile terminal 100 and a wireless communication system, communications between the mobile terminal 100 and another mobile terminal, communications between the mobile terminal 100 and an external server. Further, the wireless communication unit 110 typically includes one or more modules which connect the mobile terminal 100 to one or more networks.

To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the mobile terminal, the surrounding environment of the mobile terminal, user information, and the like. For example, in FIG. 1A, the sensing unit 140 is shown having a proximity sensor 141 and an illumination sensor 142. If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few.

The output unit 150 is typically configured to output various types of information, such as audio, video, tactile output, and the like. The output unit 150 is shown having a display unit 151, an audio output module 152, a haptic module 153, and an optical output module 154. The display unit 151 may have an inter-layered structure or an integrated structure with a touch sensor in order to facilitate a touch screen. The touch screen may provide an output interface between the mobile terminal 100 and a user, as well as function as the user input unit 123 which provides an input interface between the mobile terminal 100 and the user.

The interface unit 160 serves as an interface with various types of external devices that can be coupled to the mobile terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the mobile terminal 100 may perform assorted control functions associated with a connected external device, in response to the external device being connected to the interface unit 160.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the mobile terminal 100 at time of manufacturing or shipping, which is typically the case for basic functions of the mobile terminal 100 (for example, receiving a call, placing a call, receiving a message, sending a message, and the like). It is common for application programs to be stored in the memory 170, installed in the mobile terminal 100, and executed by the controller 180 to perform an operation (or function) for the mobile terminal 100.

The controller 180 typically functions to control overall operation of the mobile terminal 100, in addition to the operations associated with the application programs. The controller 180 may provide or process information or functions appropriate for a user by processing signals, data, information and the like, which are input or output by the various components depicted in FIG. 1A, or activating application programs stored in the memory 170. As one example, the controller 180 controls some or all of the components illustrated in FIG. 1A according to the execution of an application program that have been stored in the memory 170.

The power supply unit 190 can be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body.

Referring still to FIG. 1A, various components depicted in this figure will now be described in more detail. Regarding the wireless communication unit 110, the broadcast receiving module 111 is typically configured to receive a broadcast signal and/or broadcast associated information from an external broadcast managing entity via a broadcast channel. The broadcast channel may include a satellite channel, a terrestrial channel, or both. In some embodiments, two or more broadcast receiving modules 111 may be utilized to facilitate simultaneously receiving of two or more broadcast channels, or to support switching among broadcast channels.

The mobile communication module 112 can transmit and/or receive wireless signals to and from one or more network entities. Typical examples of a network entity include a base station, an external mobile terminal, a server, and the like. Such network entities form part of a mobile communication network, which is constructed according to technical standards or communication methods for mobile communications (for example, Global System for Mobile Communication (GSM), Code Division Multi Access (CDMA), Wideband CDMA (WCDMA), High Speed Downlink Packet access (HSDPA), Long Term Evolution (LTE), and the like).

Examples of wireless signals transmitted and/or received via the mobile communication module 112 include audio call signals, video (telephony) call signals, or various formats of data to support communication of text and multimedia messages.

The wireless Internet module 113 is configured to facilitate wireless Internet access. This module may be internally or externally coupled to the mobile terminal 100. The wireless Internet module 113 may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like. The wireless Internet module 113 may transmit/receive data according to one or more of such wireless Internet technologies, and other Internet technologies as well.

In some embodiments, when the wireless Internet access is implemented according to, for example, WiBro, HSDPA, GSM, CDMA, WCDMA, LTE and the like, as part of a mobile communication network, the wireless Internet module 113 performs such wireless Internet access. As such, the Internet module 113 may cooperate with, or function as, the mobile communication module 112.

The short-range communication module 114 is configured to facilitate short-range communications. Suitable technologies for implementing such short-range communications include BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. The short-range communication module 114 in general supports wireless communications between the mobile terminal 100 and a wireless communication system, communications between the mobile terminal 100 and another mobile terminal 100, or communications between the mobile terminal and a network where another mobile terminal 100 (or an external server) is located, via wireless area networks. One example of the wireless area networks is a wireless personal area networks.

In some embodiments, another mobile terminal (which may be configured similarly to mobile terminal 100) may be a wearable device, for example, a smart watch, a smart glass or a head mounted display (HMD), which is able to exchange data with the mobile terminal 100 (or otherwise cooperate with the mobile terminal 100). The short-range communication module 114 may sense or recognize the wearable device, and permit communication between the wearable device and the mobile terminal 100. In addition, when the sensed wearable device is a device which is authenticated to communicate with the mobile terminal 100, the controller 180, for example, may cause transmission of data processed in the mobile terminal 100 to the wearable device via the short-range communication module 114. Hence, a user of the wearable device may use the data processed in the mobile terminal 100 on the wearable device. For example, when a call is received in the mobile terminal 100, the user may answer the call using the wearable device. Also, when a message is received in the mobile terminal 100, the user can check the received message using the wearable device.

The location information module 115 is generally configured to detect, calculate, derive or otherwise identify a position of the mobile terminal. As an example, the location information module 115 includes a Global Position System (GPS) module, a Wi-Fi module, or both. If desired, the location information module 115 may alternatively or additionally function with any of the other modules of the wireless communication unit 110 to obtain data related to the position of the mobile terminal.

As one example, when the mobile terminal uses a GPS module, a position of the mobile terminal may be acquired using a signal sent from a GPS satellite. As another example, when the mobile terminal uses the Wi-Fi module, a position of the mobile terminal can be acquired based on information related to a wireless access point (AP) which transmits or receives a wireless signal to or from the Wi-Fi module.

The input unit 120 may be configured to permit various types of input to the mobile terminal 120. Examples of such input include audio, image, video, data, and user input. Image and video input is often obtained using one or more cameras 121. Such cameras 121 may process image frames of still pictures or video obtained by image sensors in a video or image capture mode. The processed image frames can be displayed on the display unit 151 or stored in memory 170. In some cases, the cameras 121 may be arranged in a matrix configuration to permit a plurality of images having various angles or focal points to be input to the mobile terminal 100. As another example, the cameras 121 may be located in a stereoscopic arrangement to acquire left and right images for implementing a stereoscopic image.

The microphone 122 is generally implemented to permit audio input to the mobile terminal 100. The audio input can be processed in various manners according to a function being executed in the mobile terminal 100. If desired, the microphone 122 may include assorted noise removing algorithms to remove unwanted noise generated in the course of receiving the external audio.

The user input unit 123 is a component that permits input by a user. Such user input may enable the controller 180 to control operation of the mobile terminal 100. The user input unit 123 may include one or more of a mechanical input element (for example, a key, a button located on a front and/or rear surface or a side surface of the mobile terminal 100, a dome switch, a jog wheel, a jog switch, and the like), or a touch-sensitive input, among others. As one example, the touch-sensitive input may be a virtual key or a soft key, which is displayed on a touch screen through software processing, or a touch key which is located on the mobile terminal at a location that is other than the touch screen. On the other hand, the virtual key or the visual key may be displayed on the touch screen in various shapes, for example, graphic, text, icon, video, or a combination thereof.

The sensing unit 140 is generally configured to sense one or more of internal information of the mobile terminal, surrounding environment information of the mobile terminal, user information, or the like. The controller 180 generally cooperates with the sending unit 140 to control operation of the mobile terminal 100 or execute data processing, a function or an operation associated with an application program installed in the mobile terminal based on the sensing provided by the sensing unit 140. The sensing unit 140 may be implemented using any of a variety of sensors, some of which will now be described in more detail.

The proximity sensor 141 may include a sensor to sense presence or absence of an object approaching a surface, or an object located near a surface, by using an electromagnetic field, infrared rays, or the like without a mechanical contact. The proximity sensor 141 may be arranged at an inner region of the mobile terminal covered by the touch screen, or near the touch screen.

The proximity sensor 141, for example, may include any of a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and the like. When the touch screen is implemented as a capacitance type, the proximity sensor 141 can sense proximity of a pointer relative to the touch screen by changes of an electromagnetic field, which is responsive to an approach of an object with conductivity. In this case, the touch screen (touch sensor) may also be categorized as a proximity sensor.

A magnetic sensor 143 indicates a sensor configured to detect an object approaching a predetermined surface or an object which exists nearby, and a position and a direction of the object, using a force of a magnetic field. That is, the magnetic sensor 143 indicates a sensor configured to measure a size and a direction of a peripheral magnetic field or a line of magnetic force. In the present invention, a plurality of 3-axis magnetic sensors 143*a*, 143*b* are provided at the mobile terminal 100 to more precisely sense a position and a direction of an object which generates a magnetic field.

For this, the plurality of 3-axis magnetic sensors 143*a*, 143*b* may be independent from each other, and may be spaced from each other in different directions. The controller 180 may execute a differentiated operation based on a size of a magnetic field measured by the plurality of 3-axis magnetic sensors 143*a*, 143*b*. More specifically, the controller 180 may detect a position, a direction, an angle, etc. of an object which generates a magnetic field, based on a size of a magnetic field measured by the plurality of 3-axis magnetic sensors 143*a*, 143*b*.

The term "proximity touch" will often be referred to herein to denote the scenario in which a pointer is positioned to be proximate to the touch screen without contacting the touch screen. The term "contact touch" will often be referred to herein to denote the scenario in which a pointer makes physical contact with the touch screen. For the position corresponding to the proximity touch of the pointer relative to the touch screen, such position will correspond to a position where the pointer is perpendicular to the touch screen. The proximity sensor 141 may sense proximity touch, and proximity touch patterns (for example, distance, direction, speed, time, position, moving status, and the like).

In general, controller 180 processes data corresponding to proximity touches and proximity touch patterns sensed by the proximity sensor 141, and cause output of visual information on the touch screen. In addition, the controller 180 can control the mobile terminal 100 to execute different operations or process different data according to whether a touch with respect to a point on the touch screen is either a proximity touch or a contact touch.

A touch sensor can sense a touch applied to the touch screen, such as display unit 151, using any of a variety of touch methods. Examples of such touch methods include a resistive type, a capacitive type, an infrared type, and a magnetic field type, among others.

As one example, the touch sensor may be configured to convert changes of pressure applied to a specific part of the display unit 151, or convert capacitance occurring at a specific part of the display unit 151, into electric input signals. The touch sensor may also be configured to sense not only a touched position and a touched area, but also touch pressure and/or touch capacitance. A touch object is generally used to apply a touch input to the touch sensor. Examples of typical touch objects include a finger, a touch pen, a stylus pen, a pointer, or the like.

When a touch input is sensed by a touch sensor, corresponding signals may be transmitted to a touch controller. The touch controller may process the received signals, and then transmit corresponding data to the controller 180. Accordingly, the controller 180 may sense which region of the display unit 151 has been touched. Here, the touch controller may be a component separate from the controller 180, the controller 180, and combinations thereof.

In some embodiments, the controller 180 may execute the same or different controls according to a type of touch object that touches the touch screen or a touch key provided in addition to the touch screen. Whether to execute the same or different control according to the object which provides a touch input may be decided based on a current operating state of the mobile terminal 100 or a currently executed application program, for example.

The touch sensor and the proximity sensor may be implemented individually, or in combination, to sense various types of touches. Such touches include a short (or tap) touch, a long touch, a multi-touch, a drag touch, a flick touch, a pinch-in touch, a pinch-out touch, a swipe touch, a hovering touch, and the like.

If desired, an ultrasonic sensor may be implemented to recognize position information relating to a touch object using ultrasonic waves. The controller 180, for example, may calculate a position of a wave generation source based on information sensed by an illumination sensor and a plurality of ultrasonic sensors. Since light is much faster than ultrasonic waves, the time for which the light reaches the optical sensor is much shorter than the time for which the ultrasonic wave reaches the ultrasonic sensor. The position of the wave generation source may be calculated using this fact. For instance, the position of the wave generation source may be calculated using the time difference from the time that the ultrasonic wave reaches the sensor based on the light as a reference signal.

The camera 121 typically includes at least one a camera sensor (CCD, CMOS etc.), a photo sensor (or image sensors), and a laser sensor.

Implementing the camera 121 with a laser sensor may allow detection of a touch of a physical object with respect to a 3D stereoscopic image. The photo sensor may be laminated on, or overlapped with, the mobile terminal. The photo sensor may be configured to scan movement of the physical object in proximity to the touch screen. In more detail, the photo sensor may include photo diodes and transistors at rows and columns to scan content received at the photo sensor using an electrical signal which changes according to the quantity of applied light. Namely, the photo sensor may calculate the coordinates of the physical object according to variation of light to thus obtain position information of the physical object.

The display unit 151 is generally configured to output information processed in the mobile terminal 100. For example, the display unit 151 may display execution screen information of an application program executing at the mobile terminal 100 or user interface (UI) and graphic user interface (GUI) information in response to the execution screen information.

In some embodiments, the display unit 151 may be implemented as a stereoscopic display unit for displaying stereoscopic images. A typical stereoscopic display unit may employ a stereoscopic display scheme such as a stereoscopic scheme (a glass scheme), an auto-stereoscopic scheme (glassless scheme), a projection scheme (holographic scheme), or the like.

The audio output module 152 is generally configured to output audio data. Such audio data may be obtained from any of a number of different sources, such that the audio data may be received from the wireless communication unit 110 or may have been stored in the memory 170. The audio data may be output during modes such as a signal reception mode, a call mode, a record mode, a voice recognition mode, a broadcast reception mode, and the like. The audio output module 152 can provide audible output related to a particular function (e.g., a call signal reception sound, a message reception sound, etc.) performed by the mobile terminal 100. The audio output module 152 may also be implemented as a receiver, a speaker, a buzzer, or the like.

A haptic module 153 can be configured to generate various tactile effects that a user feels, perceive, or otherwise experience. A typical example of a tactile effect generated by the haptic module 153 is vibration. The strength, pattern and the like of the vibration generated by the haptic module 153 can be controlled by user selection or setting by the controller. For example, the haptic module 153 may output different vibrations in a combining manner or a sequential manner.

Besides vibration, the haptic module 153 can generate various other tactile effects, including an effect by stimulation such as a pin arrangement vertically moving to contact skin, a spray force or suction force of air through a jet orifice or a suction opening, a touch to the skin, a contact of an electrode, electrostatic force, an effect by reproducing the sense of cold and warmth using an element that can absorb or generate heat, and the like.

The haptic module 153 can also be implemented to allow the user to feel a tactile effect through a muscle sensation such as the user's fingers or arm, as well as transferring the tactile effect through direct contact. Two or more haptic modules 153 may be provided according to the particular configuration of the mobile terminal 100.

An optical output module 154 can output a signal for indicating an event generation using light of a light source. Examples of events generated in the mobile terminal 100 may include message reception, call signal reception, a missed call, an alarm, a schedule notice, an email reception, information reception through an application, and the like.

A signal output by the optical output module 154 may be implemented in such a manner that the mobile terminal emits monochromatic light or light with a plurality of colors. The signal output may be terminated as the mobile terminal senses that a user has checked the generated event, for example.

The interface unit 160 serves as an interface for external devices to be connected with the mobile terminal 100. For example, the interface unit 160 can receive data transmitted from an external device, receive power to transfer to elements and components within the mobile terminal 100, or transmit internal data of the mobile terminal 100 to such external device. The interface unit 160 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the mobile terminal 100 and may include a user identity module (UIM), a subscriber identity module (SIM), a universal subscriber identity module (USIM), and the like. In addition, the device having the identification module (also referred to herein as an "identifying device") may take the form of a smart card. Accordingly, the identifying device can be connected with the terminal 100 via the interface unit 160.

When the mobile terminal 100 is connected with an external cradle, the interface unit 160 can serve as a passage to allow power from the cradle to be supplied to the mobile terminal 100 or may serve as a passage to allow various command signals input by the user from the cradle to be transferred to the mobile terminal there through. Various command signals or power input from the cradle may operate as signals for recognizing that the mobile terminal is properly mounted on the cradle.

The memory 170 can store programs to support operations of the controller 180 and store input/output data (for example, phonebook, messages, still images, videos, etc.). The memory 170 may store data related to various patterns of vibrations and audio which are output in response to touch inputs on the touch screen.

The memory 170 may include one or more types of storage mediums including a Flash memory, a hard disk, a solid-state disk, a silicon disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, an optical disk, and the like. The mobile terminal 100 may also be operated in relation to a network storage device that performs the storage function of the memory 170 over a network, such as the Internet.

The controller 180 may typically control the general operations of the mobile terminal 100. For example, the controller 180 may set or release a lock state for restricting a user from inputting a control command with respect to applications when a status of the mobile terminal meets a preset condition.

The controller 180 can also perform the controlling and processing associated with voice calls, data communications, video calls, and the like, or perform pattern recognition processing to recognize a handwriting input or a picture drawing input performed on the touch screen as characters or images, respectively. In addition, the controller 180 can control one or a combination of those components in order to implement various exemplary embodiments disclosed herein.

The power supply unit 190 receives external power or provide internal power and supply the appropriate power required for operating respective elements and components included in the mobile terminal 100. The power supply unit 190 may include a battery, which is typically rechargeable or be detachably coupled to the terminal body for charging.

The power supply unit 190 may include a connection port. The connection port may be configured as one example of the interface unit 160 to which an external charger for supplying power to recharge the battery is electrically connected.

As another example, the power supply unit 190 may be configured to recharge the battery in a wireless manner without use of the connection port. In this example, the power supply unit 190 can receive power, transferred from an external wireless power transmitter, using at least one of an inductive coupling method which is based on magnetic induction or a magnetic resonance coupling method which is based on electromagnetic resonance.

Various embodiments described herein may be implemented in a computer-readable medium, a machine-readable medium, or similar medium using, for example, software, hardware, or any combination thereof.

Figure 1B:
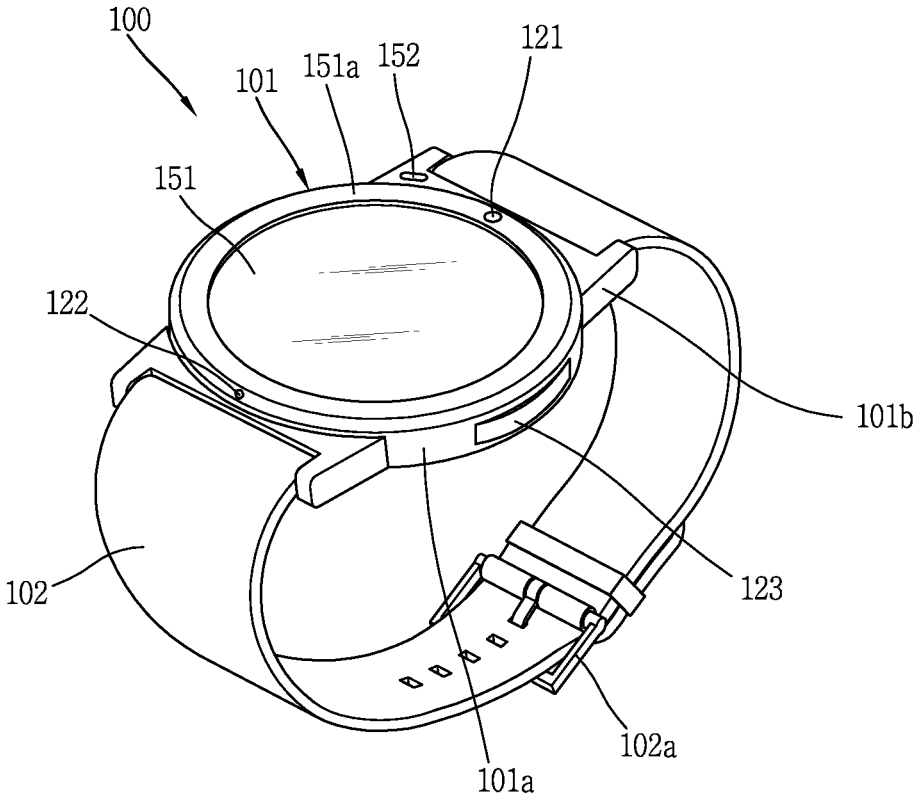
FIG. 1B is a diagram illustrating a watch type terminal according to one embodiment of the present invention, which is viewed in one direction.

FIG. 1B is a perspective view illustrating one example of a watch-type mobile terminal in accordance with another exemplary embodiment.

As illustrated in FIG. 1B, the watch-type mobile terminal 100 includes a main body 101 with a display unit 151 and a band 102 connected to the main body 101 to be wearable on a wrist.

The main body 101 may include a case having a certain appearance. As illustrated, the case may include a first case 101*a* and a second case 101*b* cooperatively defining an inner space for accommodating various electronic components. Other configurations are possible. For instance, a single case may alternatively be implemented, with such a case being configured to define the inner space, thereby implementing a mobile terminal 100 with a uni-body.

The watch-type mobile terminal 100 can perform wireless communication, and an antenna for the wireless communication can be installed in the main body 101. The antenna may extend its function using the case. For example, a case including a conductive material may be electrically connected to the antenna to extend a ground area or a radiation area.

The display unit 151 is shown located at the front side of the main body 101 so that displayed information is viewable to a user. In some embodiments, the display unit 151 includes a touch sensor so that the display unit can function as a touch screen. As illustrated, window 151*a* is positioned on the first case 101*a* to form a front surface of the terminal body together with the first case 101*a*.

The illustrated embodiment includes audio output module 152, a camera 121, a microphone 122, and a user input unit 123 positioned on the main body 101. When the display unit 151 is implemented as a touch screen, additional function keys may be minimized or eliminated. For example, when the touch screen is implemented, the user input unit 123 may be omitted.

The band 102 is commonly worn on the user's wrist and may be made of a flexible material for facilitating wearing of the device. As one example, the band 102 may be made of fur, rubber, silicon, synthetic resin, or the like. The band 102 may also be configured to be detachable from the main body 101. Accordingly, the band 102 may be replaceable with various types of bands according to a user's preference.

In one configuration, the band 102 may be used for extending the performance of the antenna. For example, the band may include therein a ground extending portion (not shown) electrically connected to the antenna to extend a ground area.

The band 102 may include fastener 102*a*. The fastener 102*a* may be implemented into a buckle type, a snap-fit hook structure, a Velcro® type, or the like, and include a flexible section or material. The drawing illustrates an example that the fastener 102*a* is implemented using a buckle.

A watch type terminal 100 according to the present invention comprises an electromagnetic wave sensor unit for wearing sensing. The electromagnetic wave sensor unit senses that a frequency is reduced in accordance with a change of capacitance if a body of a user is partially in contact with the watch type terminal 100. The controller 180 determines whether the watch type terminal 100 has been worn on a body of a user, based on a change of capacitance sensed by the electromagnetic wave sensor unit.

Figure 1C:
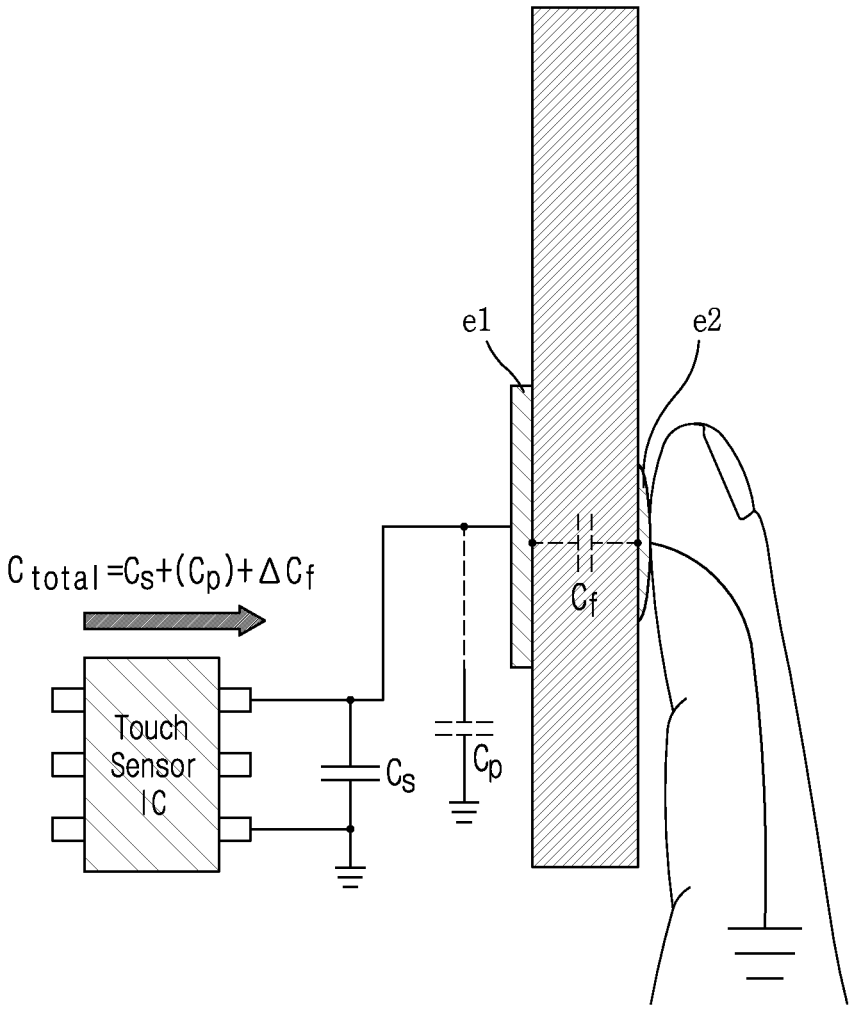
FIG. 1C is a conceptual diagram illustrating a principle of an electromagnetic wave sensing function.

FIG. 1*c* is a conceptual diagram illustrating a principle of an electromagnetic wave sensing function.

Referring to FIG. 1C, the electromagnetic wave sensor unit includes first and second electrodes e1 and e2 and a sensing module (touch sensor IC). The sensing module measures the amount of energy of electromagnetic waves output from the watch type terminal 100, which are absorbed into a body of a user. The sensing module measures a change of capacitance between the first and second electrodes e1 and e2, and the second electrode e2 is exposed externally to be in contact with a part of the body of the user.

An AC signal is used for recognition of the change of capacitance. A triangle wave of the AC signal, which has good noise property, may be used. If the body of the user is in contact with the second electrode e2, a frequency is reduced by the change of capacitance.

The second electrode e2 may be embodied as a conductive electrode unit which is in contact with a part of the body of the user. The watch type terminal 100 according to various embodiments of the present invention determines whether absorption of the electromagnetic waves is sensed in accordance with the change of capacitance, by using the electrode unit that performs a specific function, and therefore, the controller 180 senses whether the user wears the watch type terminal. Hereinafter, structural properties of the electrode unit embodied as an electrode that senses whether the user wears the watch type terminal while performing a specific function will be described.

Figure 2A:
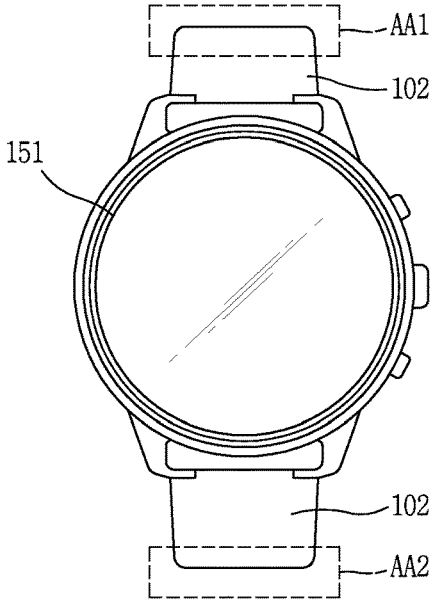
FIGS. 2A to 2C are conceptual diagrams illustrating an electromagnetic wave sensor unit that includes an electrode unit of an antenna module.
Figure 2B:
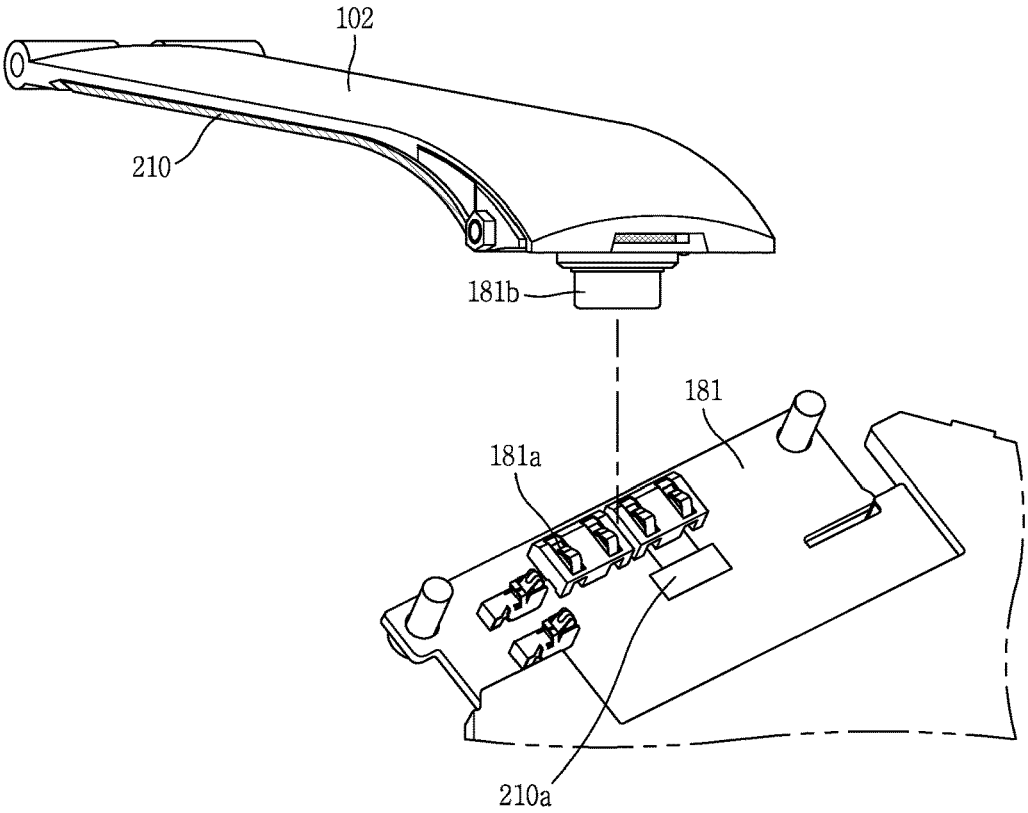
Figure 2C:
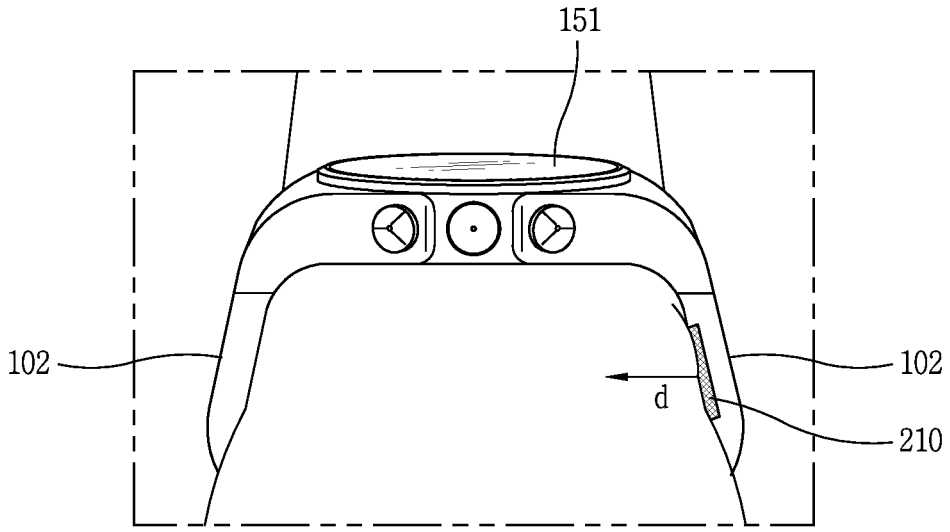

FIGS. 2A to 2C are conceptual diagrams illustrating an electromagnetic wave sensor unit that includes an electrode unit of an antenna module.

Referring to FIG. 2A, in the watch type terminal 100 according to this embodiment, first and second antenna areas AA1 and AA2, which perform wireless communication, are formed at the band 102. For example, the first antenna area AA1 is provided with an LTE MIMO antenna module, an NFC module, and a GPS module, and the second antenna area AA2 is provided with a 3G module, a GSM module and a BT/WiFi module. The first and second antenna areas AA1 and AA2 are provided with a conductive portion included in the antenna module to receive a radio signal.

Referring to FIG. 2B, the conductive portion 210 is electrically connected with a circuit board 181 installed in the main body 101. The antenna module is connected with the circuit board 181 by electric coupling of a first connector 181*a* installed in the circuit board 181 and a second connector 181*b* connected to the band 102.

The electromagnetic wave sensor unit according to this embodiment includes an electrode unit 210 corresponding to the conductive portion 210 constituting the antenna module and a sensor module 210*a* arranged on the circuit board. The sensor module 210*a* is connected to the first connector 181*a* and then electrically connected with the electrode unit 210, and senses a change of capacitance based on a body of a user, which is in contact with the electrode unit 210.

Referring to FIG. 2C, the controller 180 determines whether an object exists within a specific distance (for example, about 2 mm), through the electrode unit 210. The controller 180 performs wireless communication by means of the antenna module by receiving a radio signal through the electrode unit 210, and senses whether the user wears the watch type terminal, based on the capacitance change (and change of frequency) occurring if a part of the body of the user is in contact with the electrode unit 210.

If the conductive portion 210 is an NFC antenna and is activated in an NFC antenna mode, the controller 180 shorts electric connection between the conductive portion 210 and the sensor module 210*a*. For example, this case corresponds to a first mode in which the NFC antenna can read or write data from a tag, a second mode (P2P mode) in which the NFC antenna can transmit and receive data to and from another NFC device, and a third mode (card emulation mode) in which the NFC antenna is embodied and activated as electronic money, electronic ticket, transportation card, or non-contact credit card.

The electromagnetic wave sensor unit according to this embodiment senses that the object is located within the specific distance, that is, the user wears the watch type terminal 100 if the band 102 is in contact with a wrist of the user and the wrist of the user is in contact with the electrode unit 210. According to this embodiment, the state that the band of the watch type terminal 100 is stably worn on the wrist of the user may be determined as a wearing state.

According to the present invention, since it is sensed whether the user wears the watch type terminal 100, through the capacitance change according to a contact of the body of the user without using light which is emitted and reflected, whether the user wears the watch type terminal 100 may be sensed more exactly regardless of a skin color or tattoo of the user.

Also, since the conductive portion arranged for wireless communication is used, additional conductive member is not required to be installed outside the watch type terminal. Therefore, external appearance of the watch type terminal may be made esthetically.

Figure 3A:
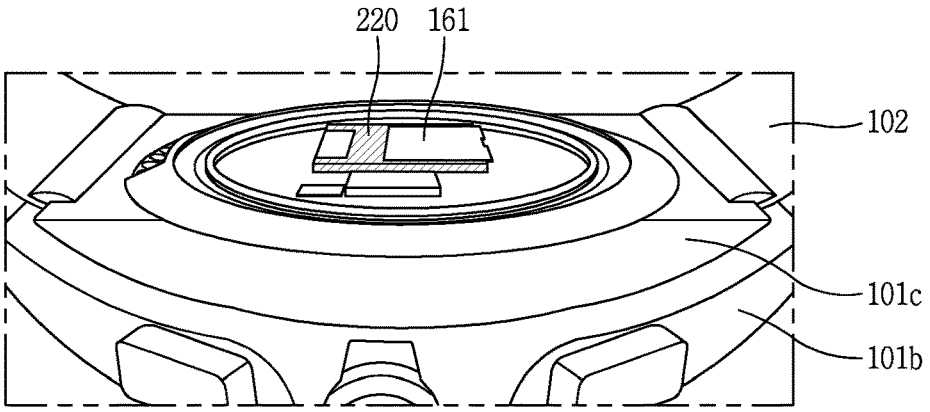
FIGS. 3A and 3B are conceptual diagrams illustrating an electromagnetic wave sensor unit according to another embodiment of the present invention.
Figure 3B:
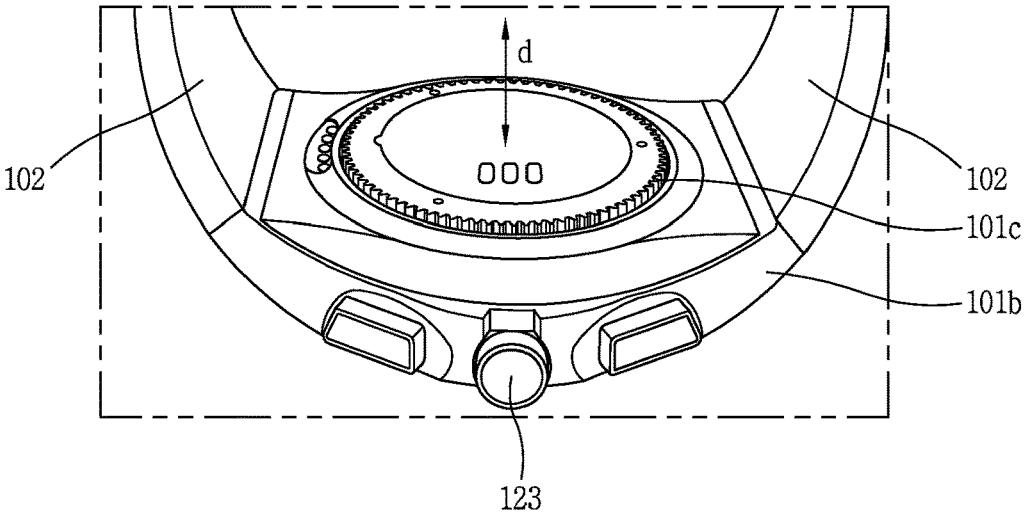

FIGS. 3A and 3B are conceptual diagrams illustrating an electromagnetic wave sensor unit according to another embodiment of the present invention.

In the watch type terminal 100 according to this embodiment, a connector 220 for installing a Usim chip 161 in an inner space of a back cover 101*c* is arranged. The connector 220 is made of a conductive material.

The electromagnetic wave sensor unit includes an electrode unit 220 comprised of the connector 220, and a sensor module electrically connected with the electrode unit 220. The connector 220 will be connected with the circuit board 181, and is electrically connected with the sensor module on the circuit board 181.

Since the Usim connector 220 is arranged to adjoin the back cover 101*c* of the main body 101, if the wrist of the user and the back cover 101*c* of the main body 101 are located within a specific distance 'd', the controller senses a wearing state.

According to this embodiment, since an absorption level of electromagnetic waves can be sensed using a structure of a metal material for installing the Usim chip 161, additional element is not required, whereby a weight of the watch type terminal 100 can be minimized and an inner space of the watch type terminal 100 can be configured efficiently.

Figure 4A:
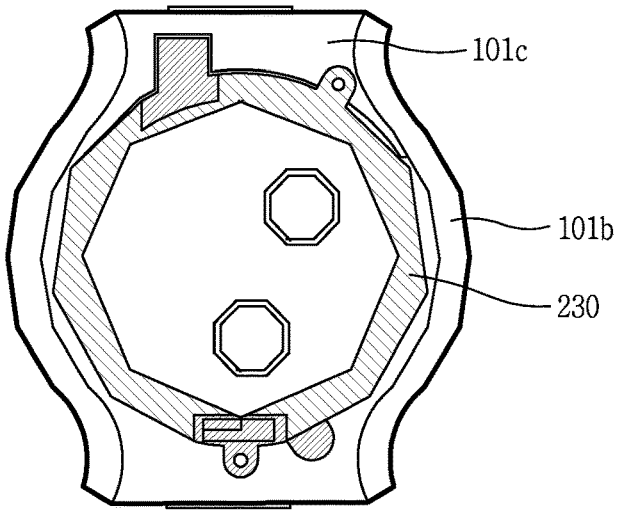
FIGS. 4A and 4B are conceptual diagrams illustrating an electromagnetic wave sensor unit according to still another embodiment of the present invention.
Figure 4B:
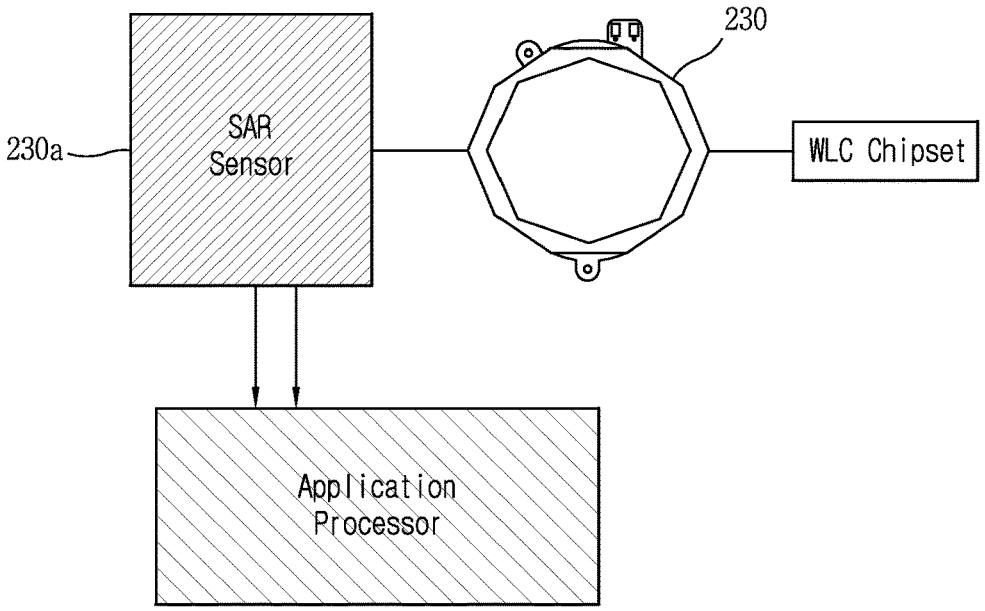

FIGS. 4A and 4B are conceptual diagrams illustrating an electromagnetic wave sensor unit according to still another embodiment of the present invention.

The watch type terminal 100 according to this embodiment includes a wireless charging module. The wireless charging module includes a wireless charging coil 230 and a wireless charging chip. Referring to FIG. 4*a*, the wireless charging coil 230 is installed inside the back cover 101*c*. The wireless charging coil 230 may be formed to adjoin an edge of the main body 101.

The electromagnetic wave sensor unit according to this embodiment includes an electrode unit 230 embodied as the wireless charging coil 230, and a sensor module 230*a*. The sensor module 230*a* senses a change of capacitance occurring if the part of the body of the user adjoins the electrode unit 230. The controller 180 electrically connected with the sensor module 230*a* determines whether the user wears the watch type terminal 100, based on the change of capacitance.

The controller 180 controls a power transmitter to sense (selection step) an object and identifies (ping step) whether the power transmitter is a power receiver and the receiver needs power transmission. Afterwards, the power transmitter identifies the power receiver and the power receiver identifies the power transmitter. Then, the power transmitter transmits a power to a wireless charging unit, which includes the wireless charging coil 230 which is a power receiver, whereby a wireless charging function is performed.

The controller 180 electrically connects the wireless charging coil 230 with a wireless charging chip (WLC chipset) and shorts electric connection between the wireless charging coil 230 with the sensor module 230*a* while the main body, which includes the wireless charging coil 230 and is arranged on a wireless charger (power transmitter), is performing perform the selection step. Meanwhile, the controller 180 electrically connects the wireless charging coil 230 with the sensor module 230*a* to use the wireless charging coil 230 as the electrode unit 230 for sensing whether the user wears the watch type terminal, while the wireless the charging coil 230 is not performing a charging function.

The wireless charging coil 230 is arranged in one area of the main body 101, which faces the body of the user, when the user wears the watch type terminal. In more detail, the wireless charging coil 230 is arranged to be relatively greater than the electrode unit 230 according to FIGS. 2*a* and 3*a*. Therefore, if the electrode unit 230 is embodied as the wireless charging coil 230, the specific distance 'd' is increased. As a result, since the wearing state can be determined even though the main body 101 is not in tightly contact with the body of the user, whether the user wears the watch type terminal can be determined more exactly by enlargement of the electrode unit 230.

Figure 5A:
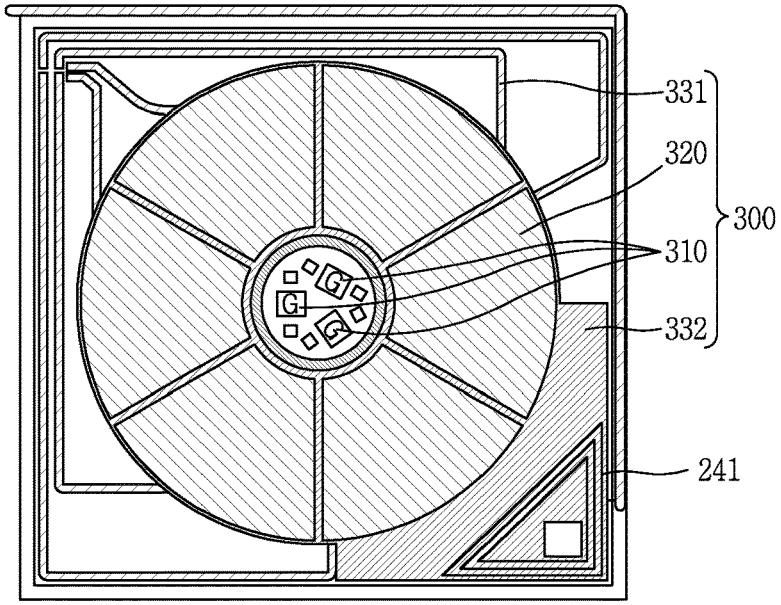
FIGS. 5A to 5C are conceptual diagrams illustrating an electromagnetic wave sensor unit arranged to adjoin a PPG sensor.
Figure 5B:
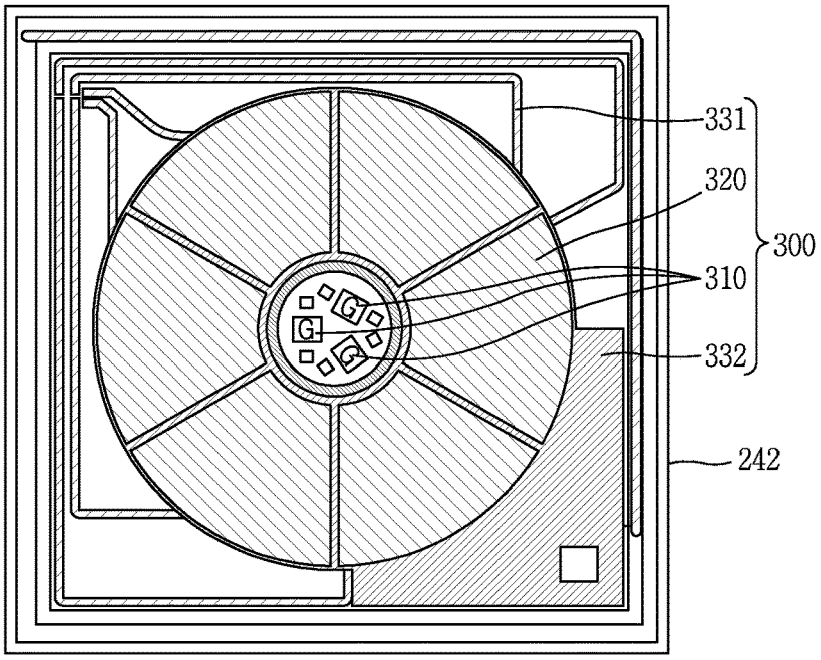
Figure 5C:
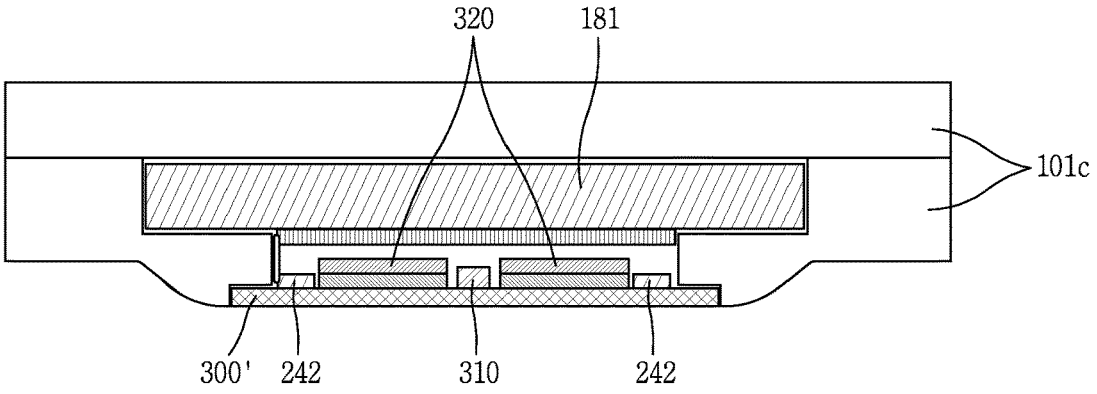

FIGS. 5A to 5C are conceptual diagrams illustrating an electromagnetic wave sensor unit arranged to adjoin a PPG sensor.

Referring to FIG. 5A, the electromagnetic wave sensor unit is formed together with a PPG sensor module 300. A photo diode (PD) layer 320 is formed on a base substrate. The photo diode layer 320 may be made in a circular disk type of which center area is provided with an opening area. A light emitting unit 310 is formed in the opening area. The light emitting unit 310 may be made of LED. Light emitted from the light emitting unit 310 is reflected by one area of the body of the user and then received in the photo diode layer 320.

An electrode line 331 for electrically connecting the photo diode layer 320 with the light emitting unit 310 is formed on the base substrate. The electrode line 331 is connected with a sensor module included in the PPG sensor module 300 and a sensor module included in the electromagnetic wave sensor unit. Also, an electrode area 332 is arranged on one area where the electrode line 331 of the base substrate is not formed. The electrode area 332 may be made of a transparent conductive electrode.

An electrode unit 241 included in the electromagnetic wave sensor unit is formed on the electrode area 332, and is made of a roof shape. The electrode unit 241 may electrically be connected with the sensor module of the electromagnetic wave sensor unit by the electrode area 332 and the electrode line 331.

The PPG sensor module 300 serves to emit light to one area of the body of the user and receive light reflected by one area of the body of the user. Therefore, the PPG sensor module 300 is formed on one area of the main body 101, which is in contact with the body of the user. Therefore, the electrode unit 241 is also arranged on one area of the main body, which may adjoin the body of the user. As a result, since the PPG sensor module 300 may determine whether it is close to the body of the user, even in the case that light is not reflected by the PPG sensor, the electromagnetic wave sensor unit may determine whether the user wears the watch type terminal.

According to this embodiment, since the electrode unit 241 is only added to one area wherein the PPG sensor module is formed, additional space for arranging the electromagnetic sensor unit located in the area close to the body of the user is not required.

FIGS. 5B and 5C are conceptual diagrams illustrating an electromagnetic wave sensor unit according to still another embodiment of the present invention. The electrode unit 242 of the electromagnetic wave sensor unit according to this embodiment is formed on the base substrate 300', and has a roof shape surrounding an edge of the photo diode layer 320.

That is, the electrode unit 242 is formed on the same surface as the light emitting unit 310 and the photo diode layer 320. The electrode unit 242 and the PPG sensor module 300 may be installed on one area of the back cover 101*c*, and are electrically connected with the circuit board 181.

Meanwhile, the base substrate 300' may be embodied as a light-transmissive window which constitutes external appearance.

Figure 6:
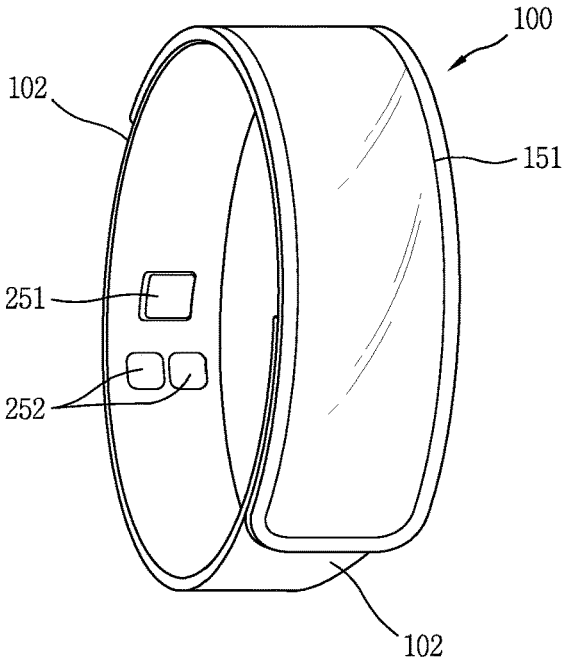
FIG. 6 is a conceptual diagram illustrating an electromagnetic wave sensor unit according to further still another embodiment of the present invention.

FIG. 6 is a conceptual diagram illustrating an electromagnetic wave sensor unit according to further still another embodiment of the present invention.

Referring to FIG. 6, first and second electrode units 251 and 252 are formed to be in contact with external appearance of the watch type terminal 100, especially the wrist on the band 102 area. For example, the first electrode unit 251 is extended from an outer surface of the band 102 to measure heartbeat, and the second electrode unit 251 is made of a conductive member for measuring a body fat. The first and second electrode units 251 and 252 are formed in one area of the band 102 which is in contact with the wrist of the user when the user wears the watch type terminal.

The electromagnetic wave sensor unit according to this embodiment may perform a wearing sensing function by electrically connecting the first electrode unit 251 or the second electrode unit 252 with the sensor module.

According to this embodiment, since the electrode member which is externally exposed is used, additional element is not required.

Figure 7A:
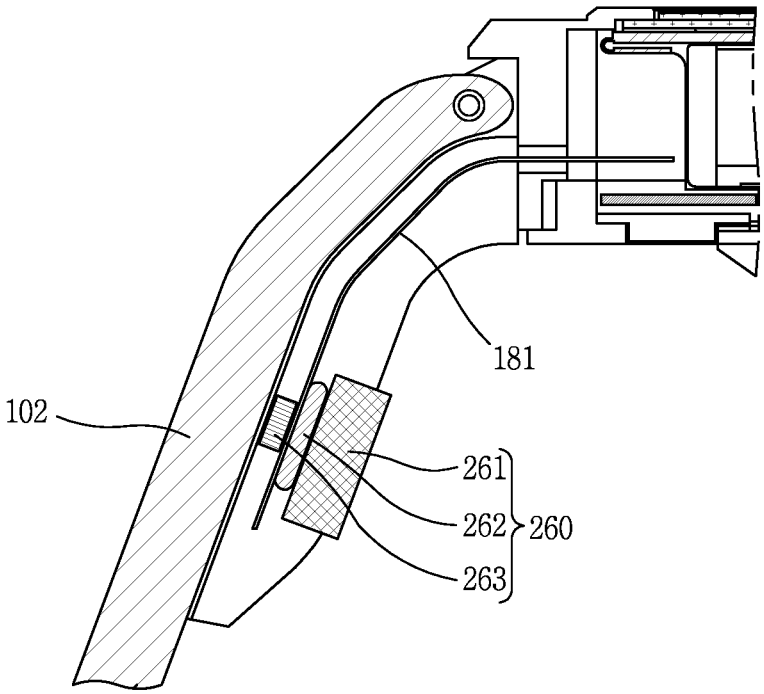
FIGS. 7A to 7C are conceptual diagrams illustrating a watch type terminal that performs a wearing sensing function by using a temperature sensor unit in accordance with another embodiment of the present invention.
Figure 7B:
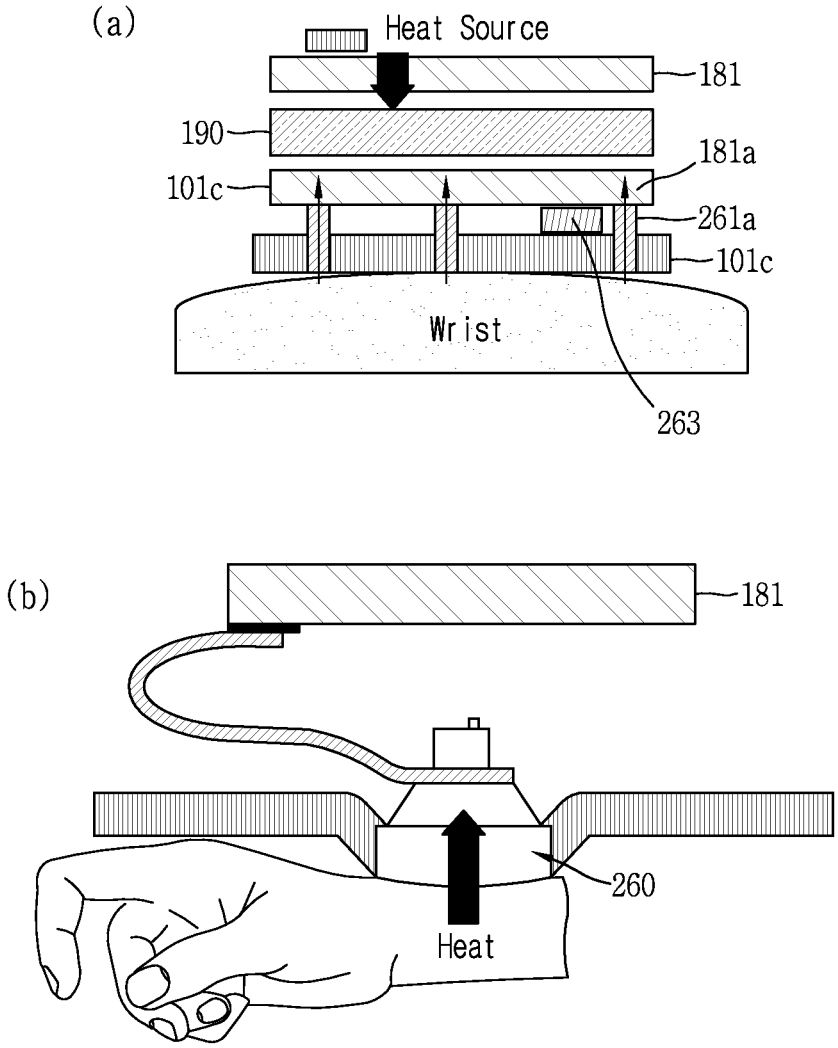
Figure 7C:
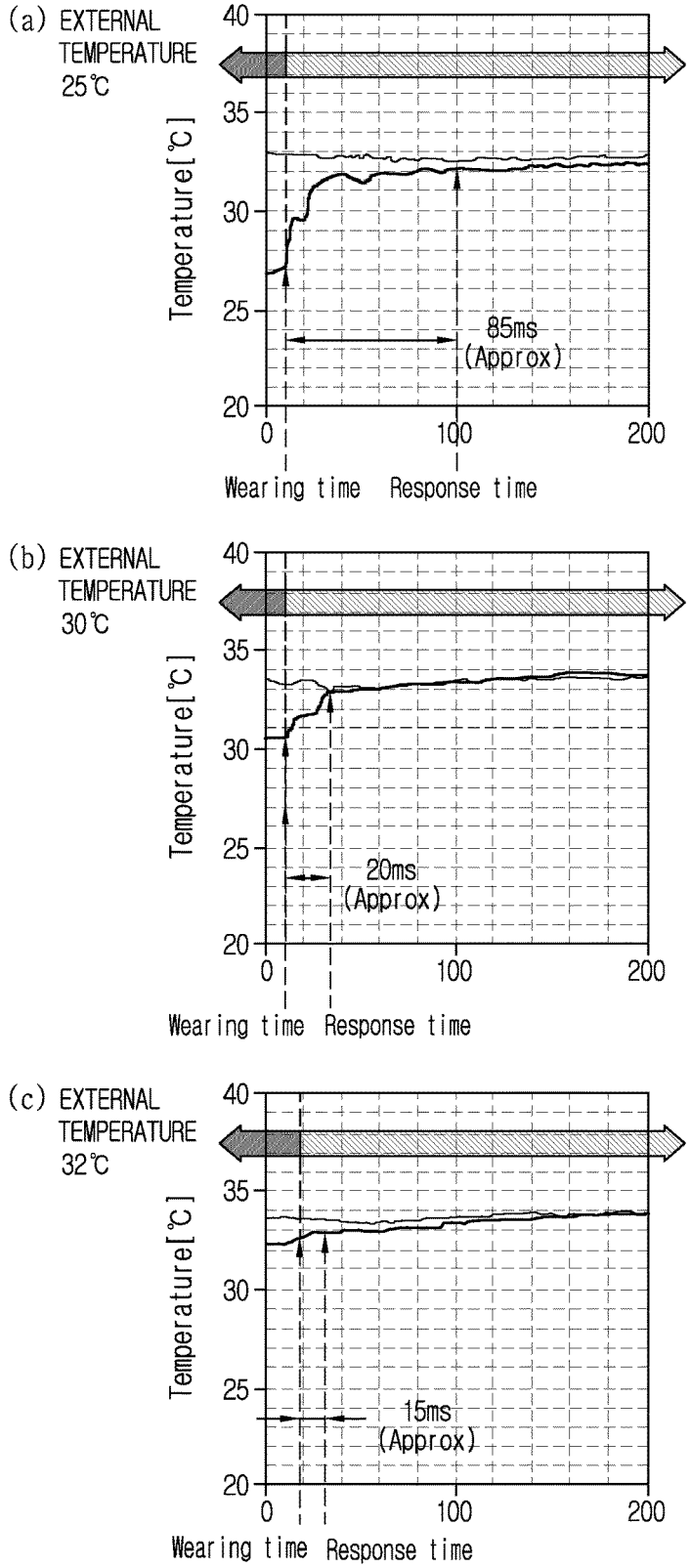

FIGS. 7A to 7C are conceptual diagrams illustrating a watch type terminal that performs a wearing sensing function by using a temperature sensor unit in accordance with another embodiment of the present invention.

Referring to FIG. 7A, the temperature sensor unit 260 includes a metal plate 261 and a conductive tape 262. The metal plate 261 is electrically connected with a temperature sensor 263 on the flexible circuit board 181 arranged inside the band 102 through the conductive tape 262. Therefore, if a skin of the user is in contact with the metal plate 261, the temperature sensor unit 260 may sense a temperature change. The flexible circuit board 181 is extended along the band 102 and connected to the main body 101.

The controller 180 according to this embodiment may sense wearing by using the temperature change sensed by the temperature sensor unit 260.

Referring to (a) and (b) of FIG. 7B, a metal portion 261*a* is formed in one area of the back cover 101*c*. The metal portion 261*a* forms external appearance of the back cover 101*c*, and is electrically connected with the temperature sensor 263 on a sub circuit board 181*a* by passing through the back cover 101*c*.

A battery 190 and a main circuit board 181 may be arranged on the sub circuit board 181*a*. Electronic components which emit heat are arranged on the main circuit board 181. That is, it is preferable that the electronic components which emit heat are arranged to be far away from the metal portion 261*a* if possible.

FIG. 7C is a graph illustrating a temperature change measured when an external temperature is varied. The controller 180 senses a wearing state if a temperature which is sensed is substantially the same as a temperature of the body of the user. However, if an external temperature is low, a response time required for the external temperature to be the same as the body temperature of the user is increased. Therefore, a predetermined reference time is increased if the external temperature is low. For example, a response time required from the time when the user wears the watch type terminal to the time when the sensed temperature reaches the body temperature of the user if the external temperature is 25° is measured to be longer than a response time required from the time when the user wears the watch type terminal to the time when the sensed temperature reaches the body temperature of the user if the external temperature is 32°.

That is, the controller 180 may determine the wearing state based on the time required in accordance with the external temperature which is sensed and increase of the sensed temperature. Therefore, if the temperature change is sensed, the controller 180 may sense the amount of the temperature change for a predetermined time and determine the wearing state if the amount of the temperature change reaches a predetermined body temperature range within a specific time.

According to this embodiment, since additional element for sensing wearing is not required, this embodiment may be used if wearing sensing based on light is not possible due to a tattoo formed in the skin of the user.

Figure 8A:
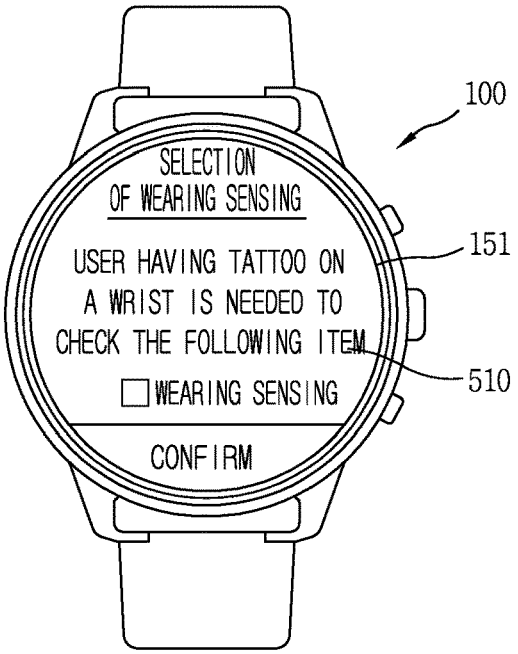
FIGS. 8A and 8B are conceptual diagrams illustrating a control method for wearing sensing.
Figure 8B:
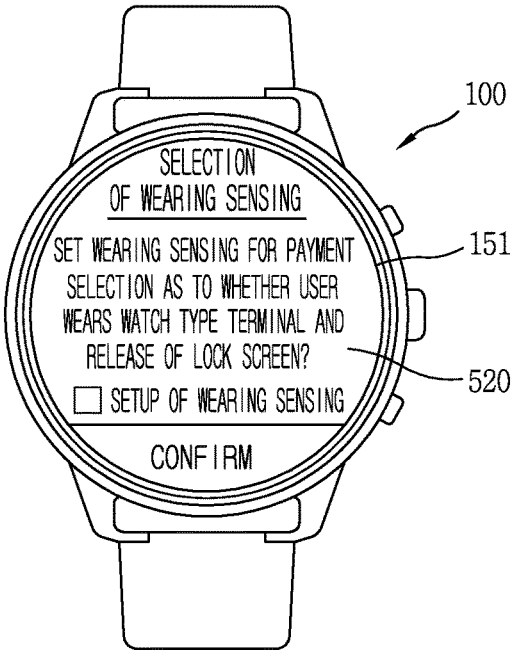

FIGS. 8A and 8B are conceptual diagrams illustrating a control method for wearing sensing.

The watch type terminal 100 according to the embodiment of FIG. 8A includes a PPG sensor module for performing a wearing sensing function by using a light output, an electromagnetic wave sensor unit included in one of the embodiments of FIGS. 2*a* to 5*c*, or/and a temperature sensor module.

The display unit 151 outputs a first setup screen 510 for selecting a method for sensing wearing. The setup screen 510 may include a text for identifying whether the user has a tattoo. If it is identified that the user has a tattoo, the controller 180 may perform a wearing sensing function by driving the electromagnetic wave sensor unit or the temperature sensor module.

The watch type terminal 100 according to the embodiment of FIG. 8B does not include a PPG sensor module for performing a wearing sensing function by using a light output. The watch type terminal 100 according to this embodiment includes an electromagnetic wave sensor unit included in one of the embodiments of FIGS. 2A to 6, or/and a temperature sensor module.

In this case, the display unit 151 displays a second setup screen 520 that includes a text for identifying whether a wearing sensing function is activated. The second setup screen 520 may include description of execution (for example, payment selection and release of locking state) of additional functions according to the wearing sensing function.

If the wearing sensing function is executed by the second setup screen 520, the controller 180 may perform wearing sensing by using the electromagnetic wave sensor unit and the temperature sensor module.

Various embodiments may be implemented using a machine-readable medium having instructions stored thereon for execution by a processor to perform various methods presented herein. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet). The processor may include the controller 180 of the mobile terminal.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A watch-type terminal comprising: a body configured to be mounted on a user's wrist;

a band connected to the body and formed to wrap the user's wrist;

a display unit mounted on the body and configured to display information;

an electrode unit formed in one area of either the body or the band and configured to perform a wireless communication function;

a first sensor connected to the electrode unit and configured to sense a capacitance change generated by the user's wrist;

a second sensor configured to sense light reflected by the user's wrist, the second sensor comprising a light emitter configured to emit light and a photo diode configured to receive and reflect the emitted light;

an antenna unit electrically connected to the electrode unit and configured to provide a radio signal to the electrode unit and perform the wireless communication function; and a controller is configured to: control the display unit to display a window for identifying presence of a mark on the user's wrist;

select the first sensor or second sensor based on a control command from the user entered via the displayed window; and determine whether the user wears the terminal by using the selected first sensor or second sensor.

2. The terminal of claim 1, further comprising a flexible circuit board connected between the body and the band, wherein the electrode unit is electrically connected to both the antenna unit and the first sensor unit via the flexible circuit board.

3. The terminal of claim 2, wherein the controller is further configured to short-circuit a connection between the electrode unit and the first sensor when the wireless communication function is performed.

4. The terminal of claim 1, wherein: the body comprises a circuit board configured to generate the control command; and the wireless communication function comprises installation and electric connection of a Usim chip to the circuit board.

5. The terminal of claim 4, wherein the body further comprises: a first case; a second case; and a back cover contacting the electrode unit and facing the user's wrist when the terminal is worn.

6. The terminal of claim 1, wherein the electrode unit has a roof shape, contacts an edge of the body and is electrically connected to a charging chip.

7. The terminal of claim 6, wherein the controller is further configured to: short-circuit a connection between the electrode unit and the first sensor; determine whether a power transmitter of an external charging device is a receiver; and identify whether the determined receiver requires power transmission.

8. The terminal of claim 1, wherein:

the second sensor further comprises an electrode line and a base substrate; a photo diode and the electrode unit are formed on the base substrate; and the electrode unit has a roof shape.

9. The terminal of claim 8, wherein the electrode unit is located on a transparent electrode area formed adjacent to one edge of the base substrate.

10. The terminal of claim 9, wherein the electrode unit surrounds the photo diode and the electrode line.

11. The terminal of claim 1, wherein the first sensor is further configured to sense an object within a specific distance of the electrode unit.

12. The terminal of claim 1, wherein the controller further controls the display unit to display a window for identifying whether a sensing function is set based on the control command.

13. The terminal of claim 1, further comprising a temperature sensor electrically connected to the electrode unit and configured to sense temperature, wherein the controller is further configured to determine whether the user wears the terminal based on a sensed temperature.

14. The terminal of claim 13, wherein the controller is further configured to determine that the user wears the terminal if the sensed temperature is within a predetermined range for a predetermined time.

15. The terminal of claim 13, wherein the predetermined time is inversely proportional to a measured external temperature.

16. A method of controlling a watch-type terminal comprising a first sensor and a second sensor, the method comprising:

performing a wireless communication function that comprises an antenna unit providing a radio signal to an electrode;

displaying a window for identifying presence of a mark on a user's wrist; selecting the first sensor or the second sensor based on a control command from the user entered via the displayed window; and determining whether the user wears the terminal by using the determined first sensor or second sensor by:

sensing a capacitance change generated by the user's wrist; and sensing light reflected by the user's wrist.

* * * * *